US011484457B1

(12) United States Patent
Corum et al.

(10) Patent No.: US 11,484,457 B1
(45) Date of Patent: Nov. 1, 2022

(54) CREMATION BAG

(71) Applicants: Sandra R. Corum, Manassas, VA (US); David M. Staten, Silk Springs, MD (US)

(72) Inventors: Sandra R. Corum, Manassas, VA (US); David M. Staten, Silk Springs, MD (US)

( * ) Notice: Subject to any disclaimer, the term of this patent is extended or adjusted under 35 U.S.C. 154(b) by 0 days.

(21) Appl. No.: 17/716,171

(22) Filed: Apr. 8, 2022

(51) Int. Cl.

| | |
|---|---|
| ***A61G 17/00*** | (2006.01) |
| ***B65D 33/25*** | (2006.01) |
| ***B65D 81/05*** | (2006.01) |
| ***B65D 33/00*** | (2006.01) |
| ***B65D 33/10*** | (2006.01) |

(52) U.S. Cl.
CPC ..... *A61G 17/00* (2013.01); *B65D 33/004* (2013.01); *B65D 33/10* (2013.01); *B65D 33/2508* (2013.01); *B65D 81/05* (2013.01)

(58) Field of Classification Search
CPC ..... A61G 17/00; B65D 33/004; B65D 33/10; B65D 33/2508; B65D 81/05
USPC ..... 383/1
See application file for complete search history.

(56) References Cited

U.S. PATENT DOCUMENTS

| | | | | |
|---|---|---|---|---|
| 2,460,712 A | | 2/1949 | Peterson | |
| 2,960,137 A | * | 11/1960 | Lipsitz | A45C 11/38 150/108 |
| 4,607,417 A | | 8/1986 | Hancovsky | |
| 4,805,776 A | * | 2/1989 | Namgyal | A45C 3/00 383/110 |
| 5,230,127 A | | 7/1993 | Zukowski et al. | |
| 5,988,879 A | * | 11/1999 | Bredderman | B65D 81/3888 383/110 |
| 6,048,099 A | * | 4/2000 | Muffett | A45C 11/20 383/110 |
| 6,254,152 B1 | | 7/2001 | Tillett | |
| 7,153,025 B1 | * | 12/2006 | Jackson | A45C 7/0059 383/110 |
| 7,621,575 B1 | | 11/2009 | Kellerman | |
| 8,424,472 B2 | | 4/2013 | Fremming | |
| 10,786,410 B2 | | 9/2020 | Venosi | |
| 2009/0178594 A1 | | 7/2009 | Fremming | |

FOREIGN PATENT DOCUMENTS

| | | | | |
|---|---|---|---|---|
| CN | 2722888 Y | * | 9/2005 | |
| DE | 202011003595 U1 | * | 6/2011 | A45C 11/24 |
| KR | 20120005658 U | * | 8/2012 | |

* cited by examiner

*Primary Examiner* — Jes F Pascua
(74) *Attorney, Agent, or Firm* — Cramer Patent & Design, PLLC; Aaron R. Cramer

(57) ABSTRACT

The cremation urn bag may comprise a bag body, a lid, one or more carrying straps, and one or more retaining straps. The cremation urn bag may be adapted to secure a cremation urn when the cremation urn is placed into the bag body and the lid is closed and sealed by a zipper. The one or more carrying straps may be adapted for a user to grasp while carrying the cremation urn. The one or more retaining straps may retain the cremation urn in place within the bag body. In some embodiments, the cremation urn bag may comprise a logo printed or embossed on the outside of the bag body and/or an information pocket adapted to display a printed card.

16 Claims, 4 Drawing Sheets

CREMATION BAG

RELATED APPLICATIONS

None.

FIELD OF THE INVENTION

The presently disclosed subject matter is directed to a specialized bag for the transportation of cremains.

BACKGROUND OF THE INVENTION

The reality of death is something we sadly all must face. While various rituals, practices, and methods of internment are used around the globe, many rely on the use of burial in a casket. Such caskets are typically made of wood, which while a renewable resource, can be quite costly, should exotic woods be used. Additionally, the size of a wooden casket is somewhat large as well. This means that the burial site needs to be correspondingly large as well. All of these requirements lead to not only a high cost, but also cause an environmental impact that will last forever.

As a result, many people now turn to cremation, but the retention of the cremains may become a lifelong sacred duty that is then passed on to future generations. This being the case there may be instances in which the cremains require transportation. However, there currently are few dignified methods of accomplishing this in a manner that also secures the cremains and limits risk of damage. Accordingly, there exists a need for a cremains transportation device to address the above mentioned concerns. The development of the cremation bag will serve to address these needs in a manner that is dignified, cost effective, and safe.

SUMMARY OF THE INVENTION

The principles of the present invention provide for a cremation urn bag that has a bag body having a front wall, a rear wall, a left side wall, a right side wall, a plurality of opposing sides, and a bottom, a lid hingedly coupled to the top of the rear wall, one or more carrying straps adapted to be grasped by a user while carrying a cremation urn, and one or more retaining straps retaining the cremation urn in place within the bag body, the rear wall, the left side wall, the right side wall, or any combination thereof. The lid is secured to the bag body by a zipper when the lid is closed. The one or more carrying straps are coupled outside of the opposing sides of the bag body the one or more retaining straps are located within the cremation urn bag and are coupled to the inside of the front wall.

The front wall, the rear wall, the left side wall, the right side wall, the lid, or any combination thereof may include a logo. The front wall, the rear wall, the left side wall, the right side wall, the opposing sides, and the bottom may be semi-rigid. The lid may be hingedly coupled to the top of the rear wall at a flap hinge. A plurality of bottom edges of the lid may align with the top edges of the bag body when the lid is in the closed position. The zipper may be closed to secure the lid to the top of the bag body and the zipper may be opened to insert or remove the cremation urn. The lid may have a plurality of equal dimensions equal to the bag body. The bag body and the lid may be made of leather. The bag body and the lid may include a liner. The liner may reduce a chance of scratching the cremation urn. The liner may be coupled to the bag body and to the lid. The liner may be made of a material selected from the group consisting of cotton, nylon, polyester, or silk. The one or more carrying straps may be flexible. The one or more carrying straps may be made of leather. The cremation urn bag may further comprise a plurality of padding material to cushion the cremation urn.

The padding material may be located between the liner and the outer walls of the bag body and the lid. The padding material may be selected from the group consisting of felt, polyester, wool, cotton, polyurethane foam, or any combination thereof. One of the individual retaining straps may be wrapped around the cremation urn to retain the cremation urn within the cremation urn bag. The one of the individual retaining straps may stretch to wrap around the cremation urn and decouple and recouple to wrap around the cremation urn. The cremation urn bag may further comprise an information pocket having a clear window adapted for holding and displaying a printed card.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
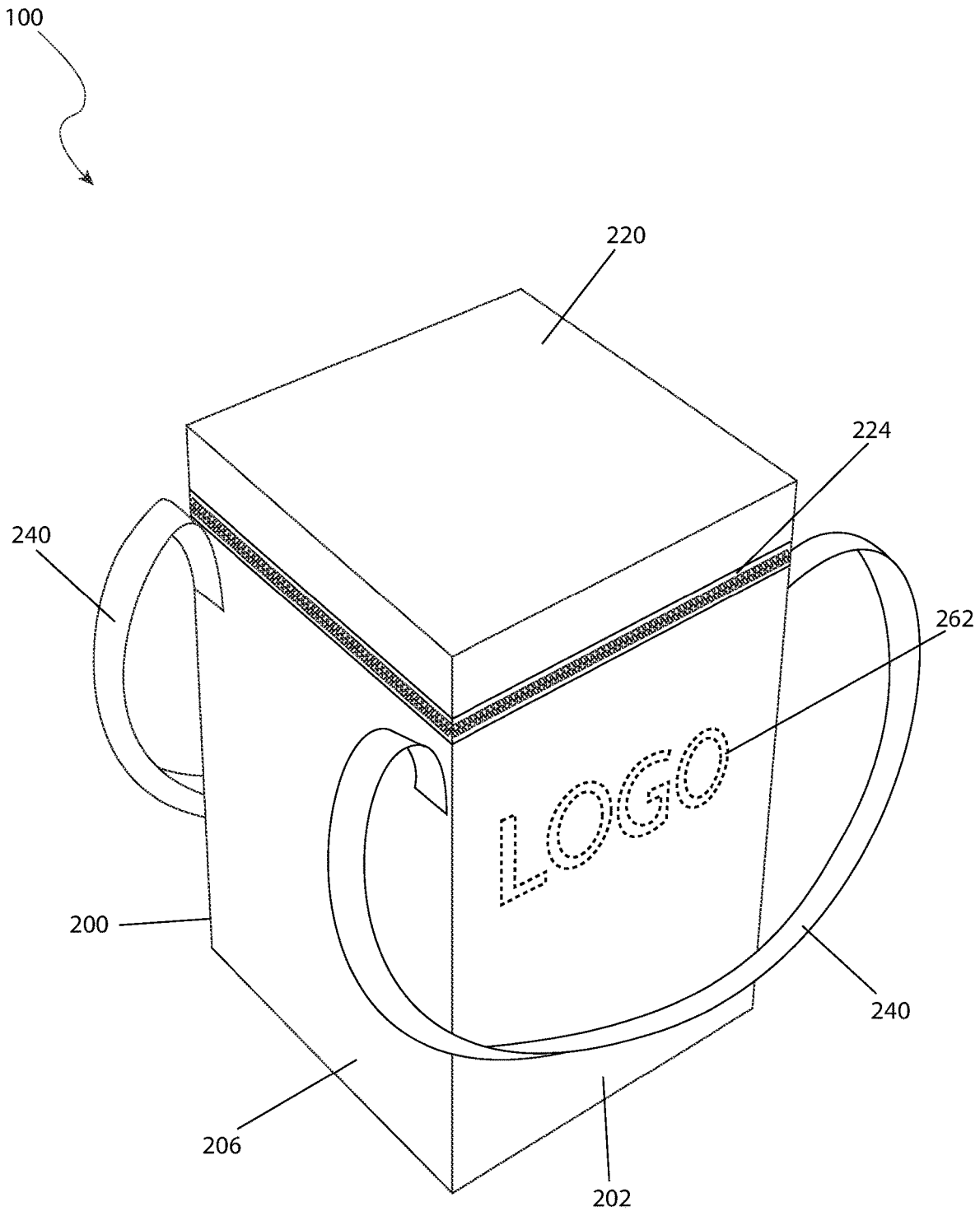
FIG. 1 is an isometric view of a cremation urn bag, according to an embodiment of the present invention, illustrating the lid closed.
Figure 2:
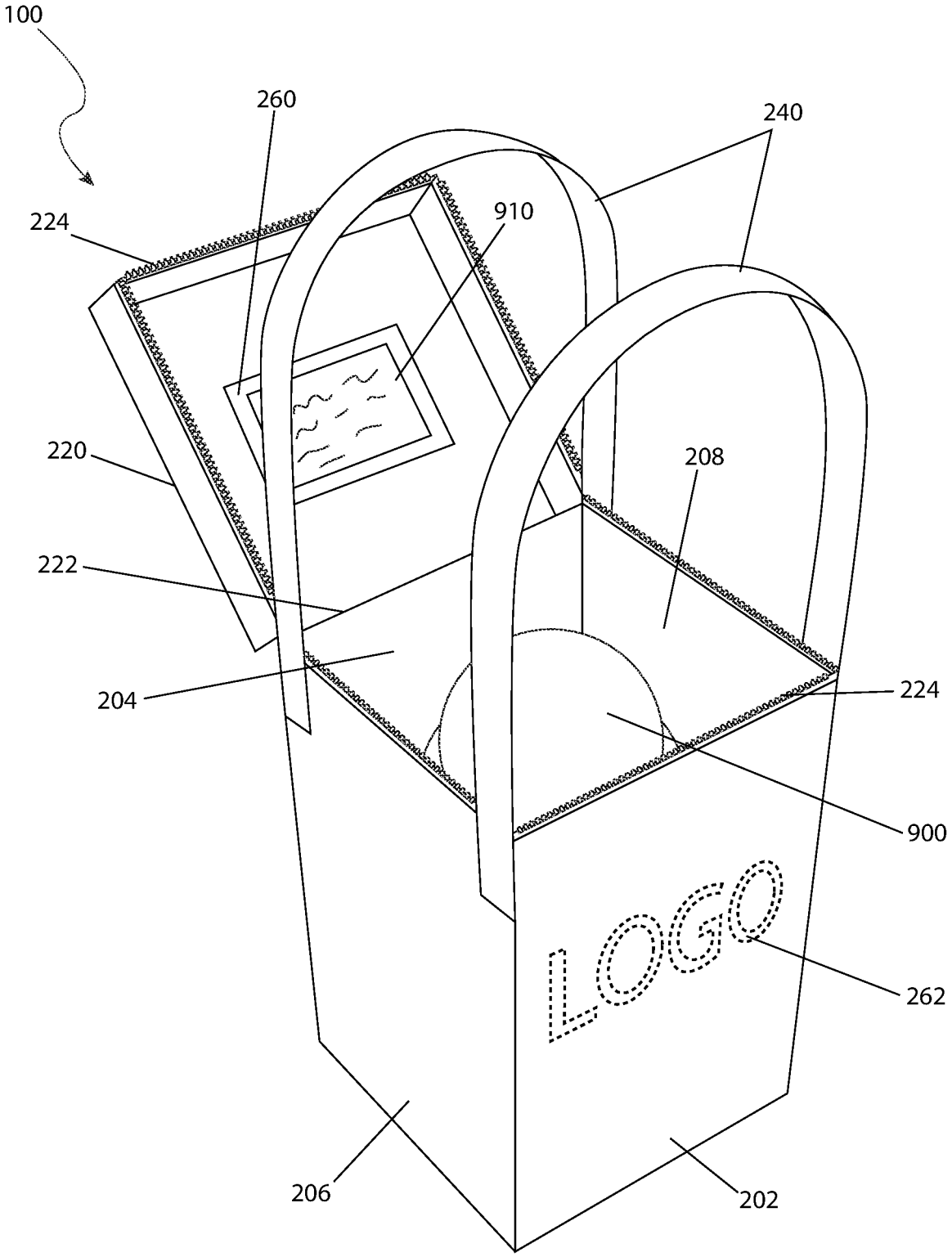
FIG. 2 is an isometric view of a cremation urn bag, according to an embodiment of the present invention, illustrating the lid open.
Figure 3:
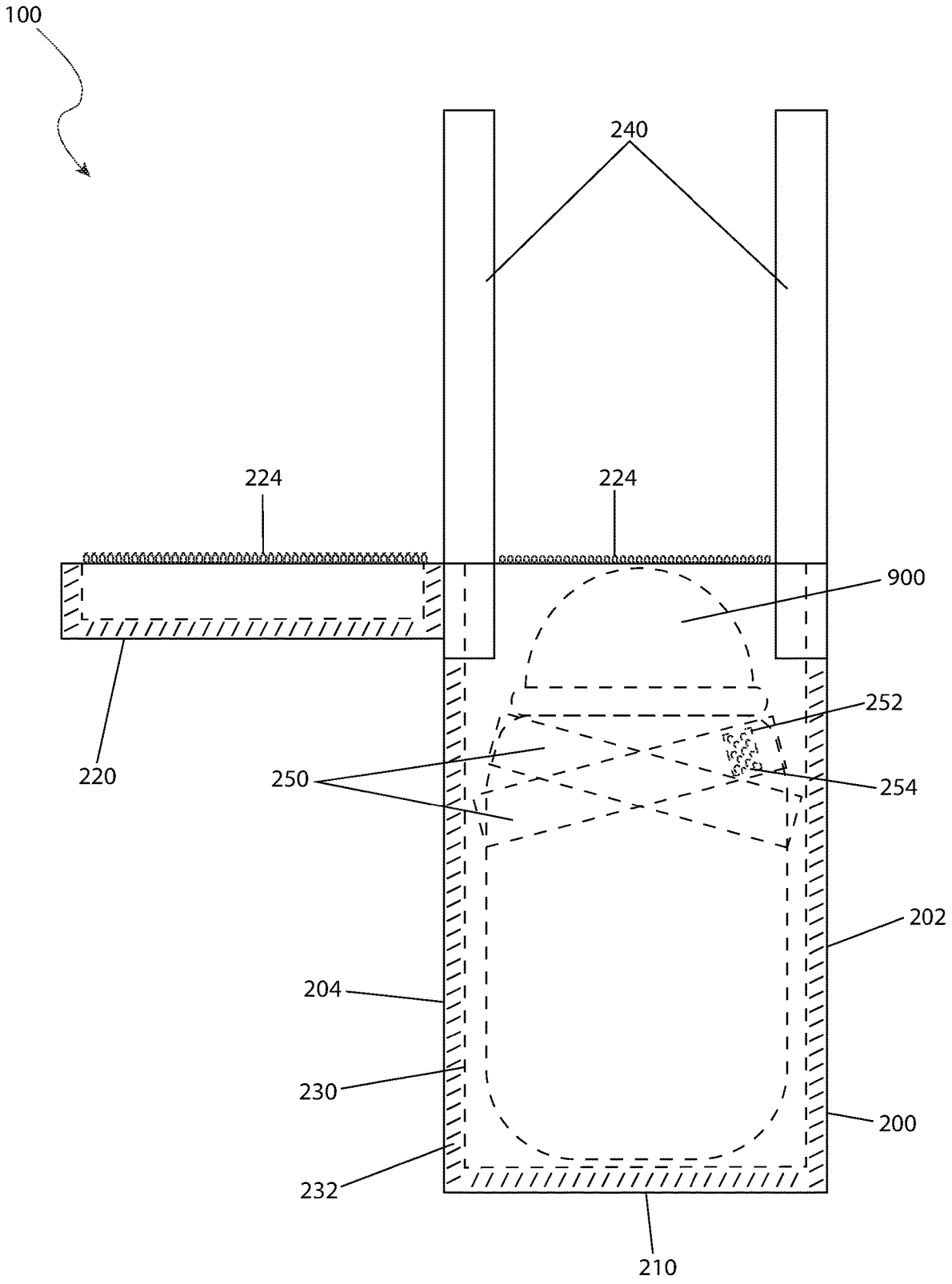
FIG. 3 is a side detail view of a cremation urn bag, according to an embodiment of the present invention.
Figure 4:
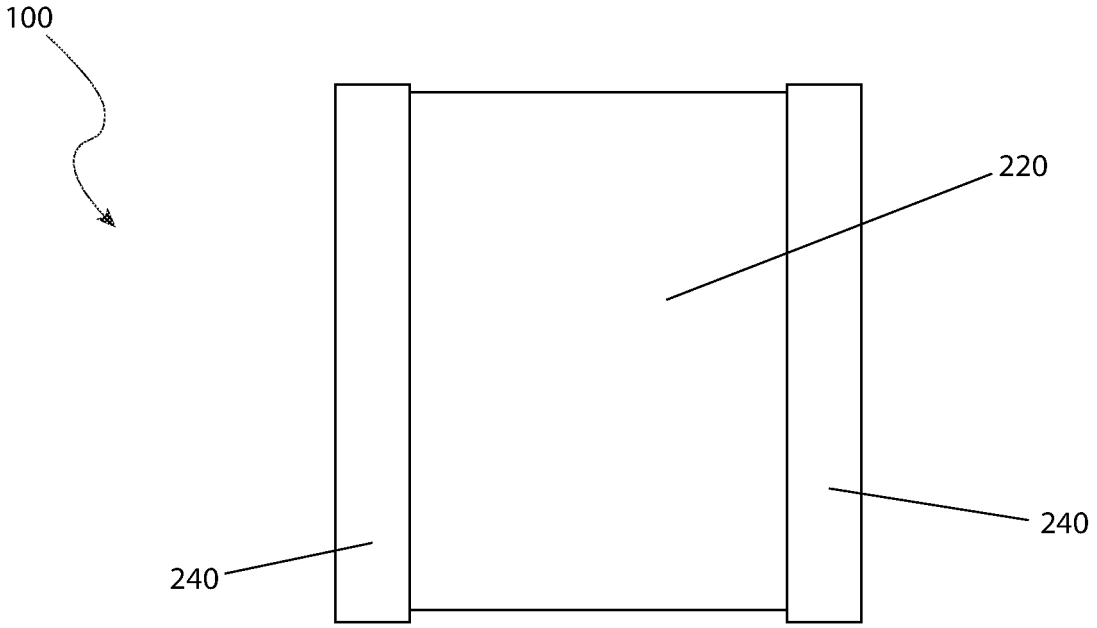
FIG. 4 is a top view of a cremation urn bag, according to an embodiment of the present invention, illustrating the lid closed.
Figure 5:
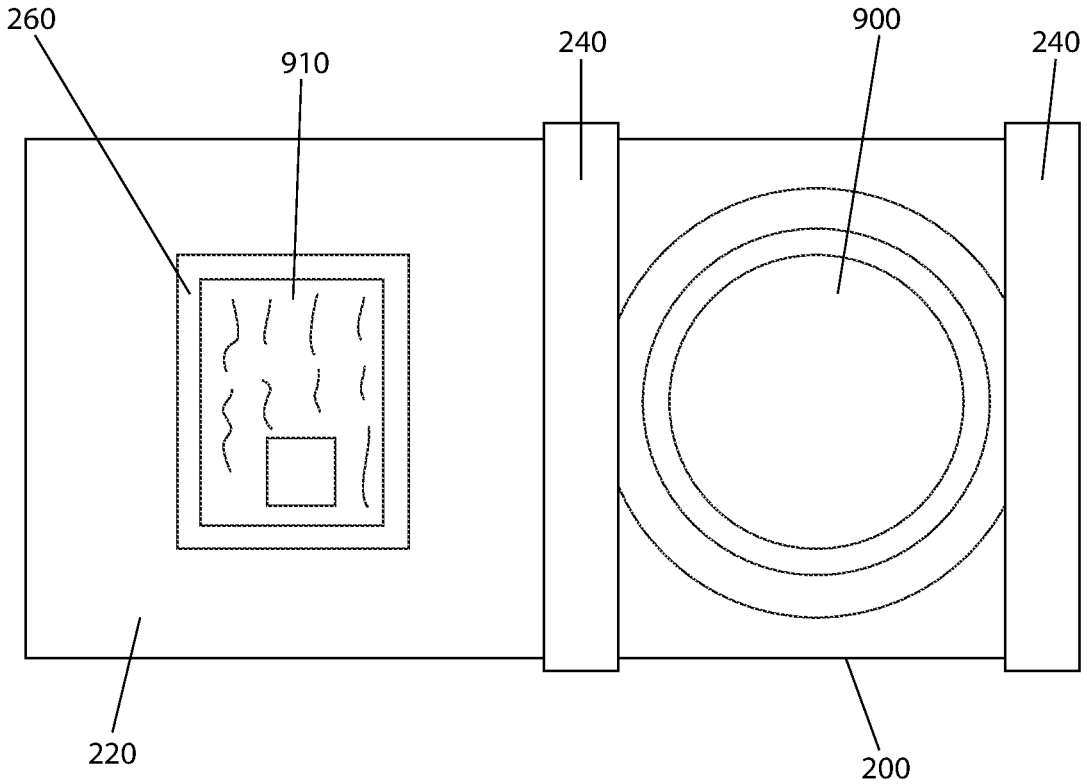
FIG. 5 is a top view of a cremation urn bag, according to an embodiment of the present invention, illustrating the lid open.

100 cremation urn bag
200 bag body
202 front wall
204 rear wall
206 left side wall
208 right side wall
210 bottom
220 lid
222 flap hinge
224 zipper
230 liner
232 padding material
240 carrying strap
250 retaining strap
252 separation point
254 hook-and-loop-type fastener
260 information pocket
262 logo
900 cremation urn
910 printed card

DESCRIPTION OF THE INVENTION

The present invention is directed to a cremation urn bag (herein described as the "invention") 100. The invention 100 may comprise a bag body 200, a lid 220, one (1) or more carrying straps 240, and one (1) or more retaining straps 250. The invention 100 may be adapted to secure a cremation urn 900 when the cremation urn 900 is placed into the bag body 200 and the lid 220 is closed and sealed by a zipper 224. The one (1) or more carrying straps 240 may be adapted for a user to grasp while carrying the cremation urn 900. The one (1) or more retaining straps 250 may retain the cremation urn 900 in place within the bag body 200.

The bag body 200 may comprise a front wall 202, a rear wall 204, a left side wall 206, a right side wall 208, and a bottom 210. The bag body 200 may have a square footprint when seen from above. In a preferred embodiment, the dimensions of the bag body 200 may be eight inches with an error of two inches (8.0+/−2.0 in.) from side to side, eight inches with an error of two inches (8.0+/−2.0 in.) from front to rear, and twelve and one-half inches with an error of two inches (12.5+/−2.0 in.) from top to bottom. The front wall 202, the rear wall 204, the left side wall 206, the right side wall 208, and the bottom 210 may be semi-rigid.

The lid 220 may be the same size as the bag body 200 from side to side and from front to rear. The lid 220 may be hingedly coupled to the top of the rear wall 204 at a flap hinge 222. The bottom edges of the lid 220 may align with the top edges of the bag body 200 when the lid 220 is in the closed position.

The lid 220 may be secured to the bag body 200 by the zipper 224 when the lid 220 is closed. The zipper 224 may be closed to secure the lid 220 to the top of the bag body 200 and the zipper 224 may be opened to insert or remove the cremation urn 900.

In some embodiments, the bag body 200 and the lid 220 may be made of leather.

The bag body 200 and the lid 220 may comprise a liner 230. The liner 230 may reduce the risk of scratching the cremation urn 900. The liner 230 may be located on the interior of the invention 100 and may be coupled to the bag body 200 and to the lid 220. As non-limiting examples, the liner 230 may be made of cotton, nylon, polyester, or silk.

In some embodiments, the invention 100 may comprise padding material 232 to cushion the cremation urn 900. The padding material 232 may be located between the liner 230 and the outer walls of the bag body 200 and the lid 220. As non-limiting examples, the padding material 232 may be felt, polyester, wool, cotton, polyurethane foam, or any combination thereof.

The one (1) or more carrying straps 240 may be coupled to the outside of opposing sides of the bag body 200. The one (1) or more carrying straps 240 may be adapted for the user to grasp when moving the invention 100. The one (1) or more carrying straps 240 may be flexible. As a non-limiting example, the one (1) or more carrying straps 240 may be leather.

The one (1) or more retaining straps 250 may be located within the interior of the invention 100 and may be coupled to the inside of the front wall 202, the rear wall 204, the left side wall 206, the right side wall 208, of any combination thereof. An individual retaining strap selected from the one (1) or more retaining straps 250 may be wrapped around the cremation urn 900 to retain the cremation urn 900 within the invention 100.

The individual retaining strap may stretch to wrap around the cremation urn 900, may decouple and recouple to wrap around the cremation urn 900, or both. As a non-limiting example, the individual retaining strap may be elastic such that the individual retaining strap may expand to wrap around the cremation urn 900 and may contract to hold the cremation urn 900 in place. As a further non-limiting example, the individual retaining strap may comprise a separation point 252 such that the individual retaining strap may separate at a midpoint of the individual retaining strap. The two (2) loose ends of the individual retaining strap may couple to each other using a hook-and-loop-type fastener 254. The individual retaining strap may separate by decoupling the two (2) loose ends of the individual retaining strap at the hook-and-loop-type fastener 254. The two (2) loose ends of the individual retaining strap may be coupled to each other using the hook-and-loop-type fastener 254 once the two (2) loose ends have been wrapped around the cremation urn 900.

In some embodiments, the invention 100 may comprise an information pocket 260. The information pocket 260 may provide a clear window adapted for holding and displaying a printed card 910. As non-limiting examples, the printed card 910 may be adapted to display identification information of a deceased person contained in the cremation urn 900, a depiction of the deceased person such as a photograph, biographical information regarding the deceased person, a remembrance such as a poem or religious verse, or any combination thereof. By way of example and not of limitation, the information pocket 260 may be made of clear vinyl or polypropylene.

In some embodiments, the front wall 202, the rear wall 204, the left side wall 206, the right side wall 208, the lid 220, or any combination thereof may comprise a logo 262. As non-limiting examples, the logo 262 may be embossed or printed on the invention 100. The logo 262 may be adapted to advertise the services of a funeral director, a cremation service, or other entity providing a service related to cremation.

In use, a cremation urn 900 containing ashes of a deceased person is sealed and lowered into the invention 100 from above. The one (1) or more retaining straps 250 may be positioned around the cremation urn 900 to hold the cremation urn 900 in place. The lid 220 is closed and zipped to secure the cremation urn 900. The invention 100 may be carried using the one (1) or more carrying straps 240.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A cremation bag, comprising:

a bag body having a plurality of opposing sides with a front wall, a rear wall, a left side wall, a right side wall, and a bottom;

a lid hingedly coupled to the top of the rear wall, the lid is secured to the bag body by a zipper when the lid is closed;

a pair of carrying straps adapted to be grasped by a user while carrying a cremation urn, the pair of carrying straps are coupled outside of the opposing sides of the bag body; and one or more retaining straps retaining the cremation urn in place within the bag body, the one or more retaining straps are located within the cremation bag and are coupled to the inside of the front wall, the rear wall, the left side wall, the right side wall, or any combination thereof;

wherein the front wall, the rear wall, the left side wall, the right side wall, the lid, or any combination thereof includes a logo to advertise a funeral director, a cremation service, or other entity providing a service related to cremation;

wherein the bag body and the lid include a liner;

wherein one of the individual retaining strap are wrapped around the cremation urn to retain the cremation urn within the cremation bag; and wherein the one of the individual retaining straps stretch to wrap around the cremation urn and decouple and recouple to wrap around the cremation urn.

2. The cremation bag, according to claim 1, wherein the front wall, the rear wall, the left side wall, the right side wall, the opposing sides, and the bottom are semi-rigid.

3. The cremation bag, according to claim 1, wherein the lid is hingedly coupled to the top of the rear wall at a flap hinge.

4. The cremation bag, according to claim 1, wherein a plurality of bottom edges of the lid aligns with the top edges of the bag body when the lid is in the closed position.

5. The cremation bag, according to claim 1, wherein the zipper is closed to secure the lid to the top of the bag body and the zipper is opened to insert or remove the cremation urn.

6. The cremation bag, according to claim 1, wherein the lid has a plurality of equal dimensions equal to the bag body.

7. The cremation bag, according to claim 1, wherein the bag body and the lid are made of leather.

8. The cremation bag, according to claim 1, wherein the liner reduces a chance of scratching the cremation urn.

9. The cremation bag, according to claim 1, wherein the liner is coupled to the bag body and to the lid.

10. The cremation bag, according to claim 1, wherein the liner is made of a material selected from the group consisting of cotton, nylon, polyester, or silk.

11. The cremation bag, according to claim 1, wherein the pair of carrying straps are flexible.

12. The cremation bag, according to claim 1, wherein the pair of carrying straps are made of leather.

13. The cremation bag, according to claim 1, further comprising a plurality of padding material to cushion the cremation urn.

14. The cremation bag, according to claim 13, wherein the padding material is located between the liner and a plurality of outer walls of the bag body and the lid.

15. The cremation bag, according to claim 13, wherein the padding material is selected from the group consisting of felt, polyester, wool, cotton, polyurethane foam, or any combination thereof.

16. The cremation bag, according to claim 1, further comprising an information pocket having a clear window adapted for holding and displaying a printed card.

* * * * *